US012486081B1

(12) United States Patent
Quade

(10) Patent No.: US 12,486,081 B1
(45) Date of Patent: Dec. 2, 2025

(54) CAULK TUBE CAP

(71) Applicant: Jordan Laurent Quade, Minneapolis, MN (US)

(72) Inventor: Jordan Laurent Quade, Minneapolis, MN (US)

( * ) Notice: Subject to any disclaimer, the term of this patent is extended or adjusted under 35 U.S.C. 154(b) by 0 days.

(21) Appl. No.: 18/678,078

(22) Filed: May 30, 2024

(51) Int. Cl.
*B65D 41/22* (2006.01)

(52) U.S. Cl.
CPC ..... *B65D 41/22* (2013.01)

(58) Field of Classification Search
CPC ..... B65D 41/22; B65D 39/16
USPC ..... 220/287, 212.5; 215/305; D9/442, 443
See application file for complete search history.

(56) References Cited

U.S. PATENT DOCUMENTS

D42,504 S * 5/1912 Gardner ..... D9/442
D204,909 S * 5/1966 Russell ..... D9/442
D329,980 S * 10/1992 Powell ..... D9/443
6,000,566 A * 12/1999 Kost ..... B65D 39/0023 215/48
6,202,869 B1 * 3/2001 Sullivan ..... B65D 50/048 215/217
6,824,026 B1 * 11/2004 Boutwell ..... B05C 17/00516 222/326
8,342,351 B2 * 1/2013 Hobbs, Sr. ..... B65D 41/023 220/254.1
D803,054 S * 11/2017 van Spronsen ..... D9/443
2004/0016776 A1 * 1/2004 Williamson, IV ..... B05C 17/00596 220/795
2004/0216340 A1 * 11/2004 Woods ..... B65D 51/245 215/230
2009/0014481 A1 * 1/2009 Benetti ..... B65D 53/06 222/562
2013/0112720 A1 * 5/2013 Cross ..... B65D 47/06 222/567

FOREIGN PATENT DOCUMENTS

JP 3214192 U * 12/2017

OTHER PUBLICATIONS (25 pack) Lil Pecker Caulk Saver Sealer Caps. (n.d.). eBay. https://www.ebay.com/itm/114911859407.
Amazon.com: (25 pack) Lil Pecker Caulk Saver Sealer Caps—Caulking Tube Covers—Reusable: Industrial & Scientific. (n.d.). https://www.amazon.com/Pack-Pecker-Caulk-Saver-Sealer/dp/B06XK92QZF.
(25 pack) Lil Pecker Caulk Saver Sealer Caps. (n.d.-b). Walmart. https://www.walmart.com/ip/25-Pack-Lil-Pecker-Caulk-Saver-Sealer-Caps/203366438.

* cited by examiner

*Primary Examiner* — Orlando E Aviles
*Assistant Examiner* — Niki M Eloshway
(74) *Attorney, Agent, or Firm* — Dunlap Bennett & Ludwig, PLLC

(57) ABSTRACT

A cap for sealing caulk tubes is disclosed. The cap is equipped with a sealing mechanism made of high-quality silicone rubber. This material not only ensures a secure and airtight seal but also offers resistance to moisture, making the cap suitable for sealing caulking tubes. The inner diameter of the closed end of the cap is innovatively designed to be smaller and in a similar shape to that of caulking tube applicator tips, optimizing the cap's performance. This size reduction contributes to a more secure fit and improved sealing capabilities, preventing moisture and air from reaching the opened tip of caulking tubes.

8 Claims, 4 Drawing Sheets

CAULK TUBE CAP

BACKGROUND OF THE INVENTION

The present invention relates sealing the open end of a tube of caulk and, more particularly, to a device for sealing caulking tubes that have previously been opened and have remaining contents.

The sealing of caulk tubes can often be difficult once the tube has been opened. In order to properly seal the tube, it must be a 100% air-tight seal in order to prevent the remaining contents from curing.

Therefore, a caulk tube cap is required that can effectively and efficiently seal the tube after use.

SUMMARY OF THE INVENTION

In one aspect of the present invention, a caulk tube cap is equipped with a sealing mechanism made of high-quality silicone rubber. This material not only ensures a secure and airtight seal, but also resists moisture, making the cap suitable for sealing caulking tubes.

In another aspect of the present invention, the inner diameter of the closed end of the cap is innovatively designed to be smaller and in a similar shape to that of conventional caulking tube applicator tips, thereby optimizing the performance of the cap of the present invention. This size reduction contributes to a more secure fit and improved sealing capabilities, preventing moisture and air from reaching the opened tip of caulking tubes.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a caulk tube cap that provides improved sealing and a user-friendly solution for sealing the opened end of a caulk tube. The bright color (preferably orange), finger grip holds, silicone rubber sealing, and reduced size on the inner diameter collectively contribute to a cap that excels in both functionality and convenience.

Caulking tubes that have previously been opened and have remaining contents need to be sealed to protect the remaining contents for future use. The invention claimed here solves this problem. As described in more detail below, and as seen in FIGS. 1-7, the claimed invention differs from what currently exists, as the material and shape of the caulk tube cap in accordance with a preferred embodiment of the present invention provides improved sealing of an opened caulk tube.

In a preferred embodiment, the cap of the present invention is equipped with a sealing mechanism made of high-quality silicone rubber. This material not only ensures a secure and airtight seal, but also offers resistance to moisture, making the cap suitable for sealing caulking tubes. The inner diameter of the closed end of the cap is innovatively designed to be smaller and in a similar shape to that of conventional caulking tube applicator tips, optimizing its performance. This size reduction contributes to a more secure fit and improved sealing capabilities, preventing moisture and air from reaching the opened tip of caulking tubes.

Figure 1:
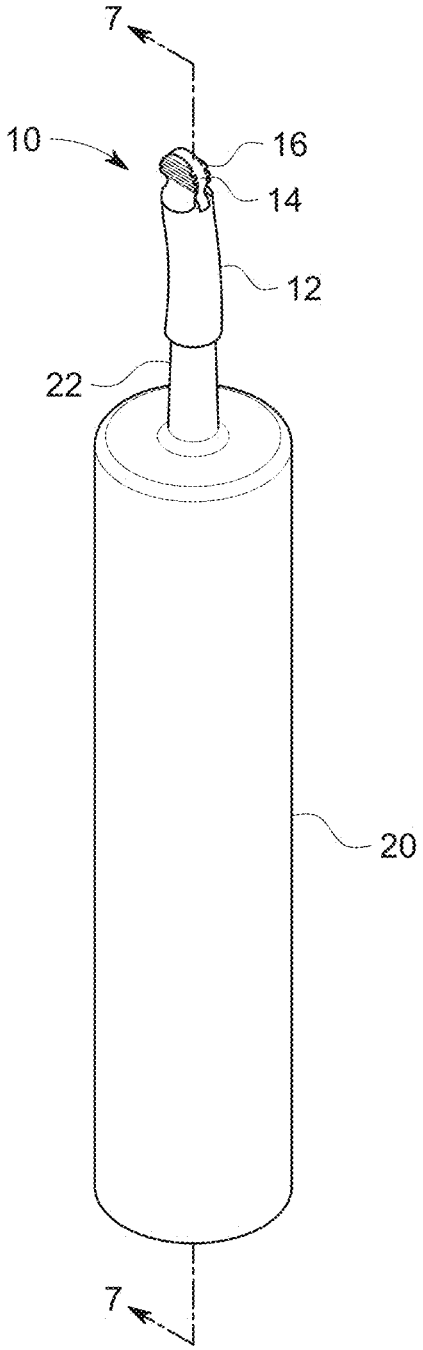
FIG. 1 is a perspective view of a caulk tube cap in accordance with a preferred embodiment of the present invention, show in use sealing a caulk tube tip.
Figure 2:
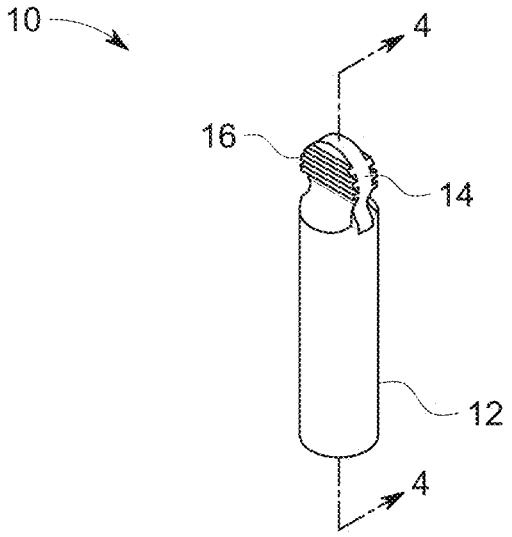
FIG. 2 is a top front perspective view of the cap shown in FIG. 1.
Figure 3:
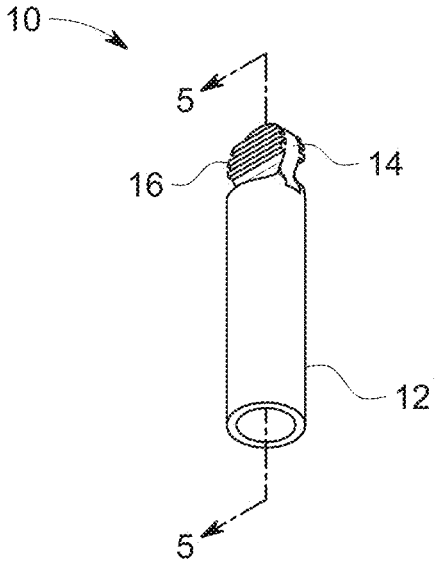
FIG. 3 is a bottom front perspective view of the cap shown in FIG. 1.
Figure 4:
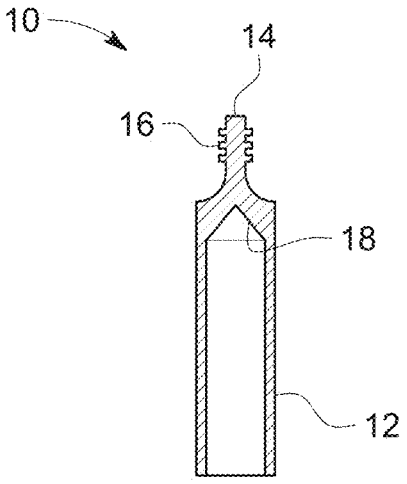
FIG. 4 is a section view of the invention, taken along line 4-4 in FIG. 2.
Figure 5:
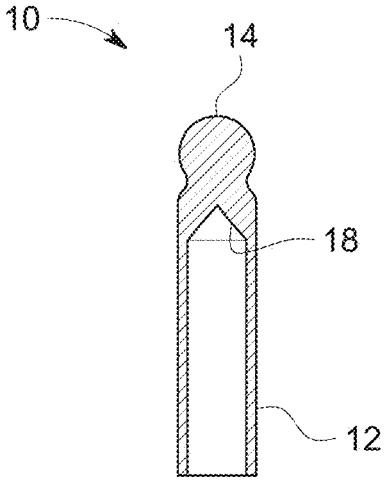
FIG. 5 is a section view of the invention, taken along line 5-5 in FIG. 3.
Figure 6:
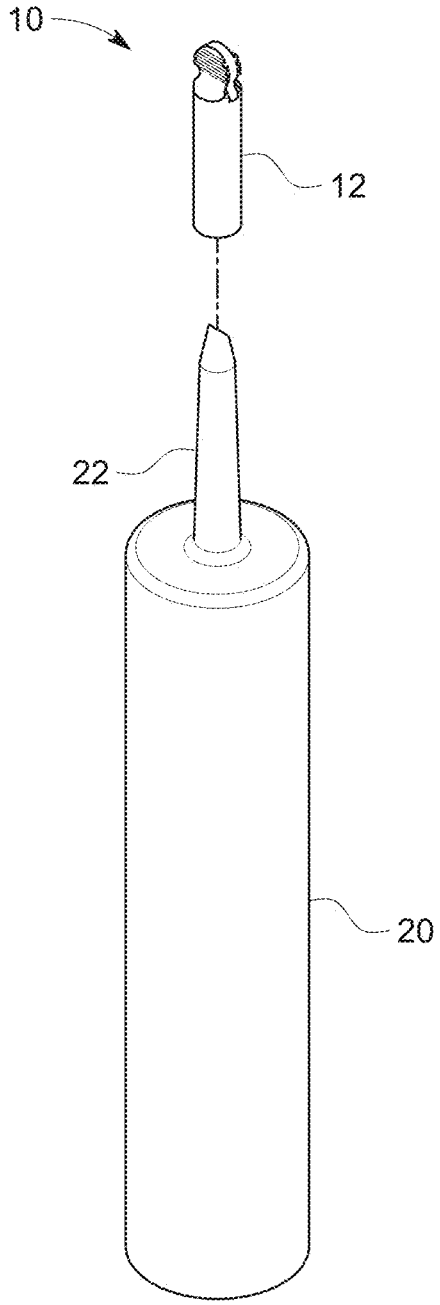
FIG. 6 is an exploded perspective view of the invention, showing the installation of the cap of the present invention onto the tip of a caulk tube.
Figure 7:
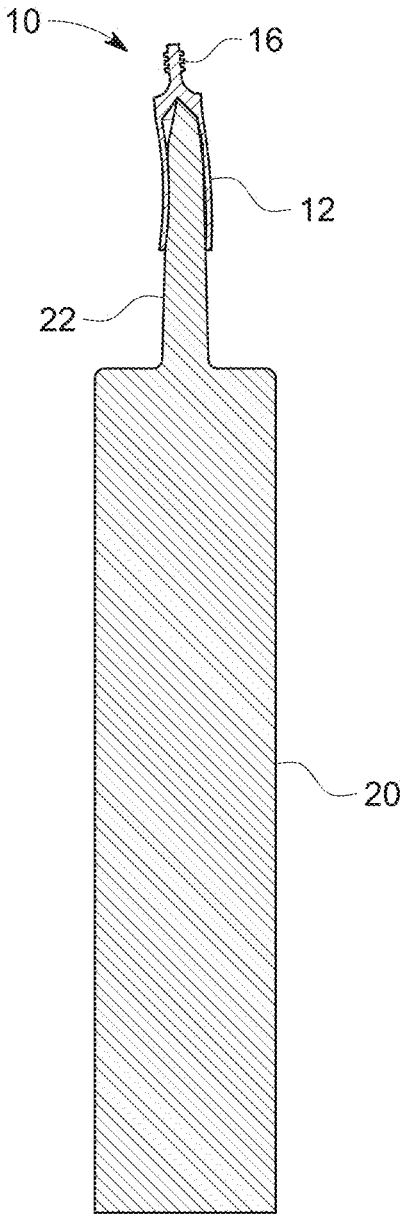
FIG. 7 is a section of the invention, taken along line 7-7 in FIG. 1.

FIG. 1 depicts a conventional caulking tube 20 having a tip 22 that has been opened (see FIGS. 6 and 7). The cap 10 of the present invention is directed at sealing that open tip 22 to prevent moisture and air from reaching the remaining caulk within tube 20.

As seen in FIGS. 1-7, cap 10 comprises a base sleeve portion 12 having a grip portion 14 at one end thereof. In a preferred embodiment, grip portion 14 is a flattened disk shape and comprises ridges 16 to assist in placement and removal of cap 10 from tip 22. In a preferred embodiment, base sleeve portion 12 is cylindrical in shape and is open at one end to accept tip 22 and is closed at the other end. In a preferred embodiment, the interior of the closed end of sleeve 12 terminates in a pointed or angled shape to further accept tip 22 of the caulk tube 20 (see FIGS. 4, 5 and 7). In a preferred embodiment, cap 10 is made of a silicone rubber and is a bright orange color to facilitate easy and quick location of the cap, especially in environments where multiple items may be present.

When the caulking cap 10 is pushed onto the tip 22 of an opened caulking tube 20 the silicone rubber construction allows for stretch well forming to the shape of the caulking tube tip 22. This creates an air-tight seal around the sides of the cap 10 (see FIG. 7, by way of example). The reduced size at the inner closed end 18 of the cap 10 conforms to the shape of the caulking tube tip 22. This reduces any air space between the cap 10 and the opened tip 22 of the caulking tube 20. The stretch fit and shape of the closed end 18 creates an air-tight seal and limits any air being left at the tip 22 of the caulking tube 20. The finger grip hold 14 is designed to provide a comfortable and secure hold, allowing users to effortlessly pull the cap 10 off with ease while maintaining a good grip. This is needed to release the air-tight stretch seal of the cap 10 from the caulk tube tip 22.

In use, cap 10 is pushed onto an open caulking tube tip 22 until the caulking tube tip 22 hits the closed end 18 of the cap 10 or meets resistance. The sides of the cap 10 are then gripped and pulled towards the caulk tube body 20, thus stretching the cap 10 on and around the caulking tube tip 22. When the caulking tube 20 is to be reused, the grip 14 at the top of the cap 10 is firmly squeezed between two fingers and pulled until the cap 10 is fully removed from the caulking tube tip 22.

As one of skill in the art will appreciate having read and considered thus disclosure, cap 10 of the present invention can be used anywhere an air-tight seal is needed on an item in a similar size and shape to a caulking tube tip 22.

It should be understood, of course, that the foregoing relates to exemplary embodiments of the invention and that modifications may be made without departing from the spirit and scope of the invention as set forth in the following claims.

What is claimed is:

1. A caulking tube cap comprising:

a cylindrical base sleeve portion having an open end and a closed end, the cylindrical base sleeve portion defining an outer wall;

the open end configured to receive an opened tip of a caulking tube;

the closed end having an interior surface that tapers to a pointed configuration for engaging the opened tip of the caulking tube;

a flattened disk-shaped grip portion extending outwardly from the closed end of the cylindrical base sleeve portion;

a curved transition section connecting the outer wall of the cylindrical base sleeve portion to the flattened disk-shaped grip portion; and a plurality of ridges formed on an outer surface of the flattened disk-shaped grip portion to facilitate gripping during placement and removal of the caulking tube cap.

2. The caulking tube cap of claim 1, wherein the plurality of ridges are arranged in a radial pattern extending outwardly from a center of the flattened disk-shaped grip portion.

3. The caulking tube cap of claim 1, wherein the cap is made of silicone rubber.

4. The caulking tube cap of claim 1, wherein an inner diameter of the open end is smaller than an outer diameter of the tip of the caulking tube to create an interference fit with the caulking tube tip.

5. The caulking tube cap of claim 1, wherein the pointed configuration comprises angled walls that converge toward an apex at the interior surface of the closed end.

6. The caulking tube cap of claim 1, wherein the cap is made of colored silicone rubber.

7. The caulking tube cap of claim 1, wherein the curved transition section has a radius of curvature that provides a smooth geometric transition between the cylindrical outer wall and the flattened disk-shaped grip portion.

8. The caulking tube cap of claim 1, wherein the cylindrical base sleeve portion, the curved transition section, and the flattened disk-shaped grip portion are formed as a unitary structure.

* * * * *